US005094073A

United States Patent [19]

Wörner

[11] Patent Number: 5,094,073

[45] Date of Patent: Mar. 10, 1992

[54] DEVICE FOR THE CATALYTIC CLEANING OR OTHER TREATMENT OF INTERNAL COMBUSTION ENGINE EXHAUST GASES WITH TWO EXHAUST GAS TREATING BODIES AND A PROTECTIVE RING BETWEEN THEM

[75] Inventor: Siegfried Wörner, Esslingen, Georg Wirth, Kirchheim, Peter Zacke, Albershausen, all of Fed. Rep. of Germany

[73] Assignee: J. Eberspächer, Esslingen, Fed. Rep. of Germany

[21] Appl. No.: 494,978

[22] Filed: Mar. 16, 1990

[30] Foreign Application Priority Data

Mar. 17, 1989 [DE] Fed. Rep. of Germany ..... 3908887
Dec. 22, 1989 [DE] Fed. Rep. of Germany ..... 89123835

[51] Int. Cl.[5] ..... F01N 3/28

[52] U.S. Cl. ..... 60/299; 60/311; 60/322; 55/466; 55/DIG. 30; 422/171; 422/180

[58] Field of Search ..... 60/299, 301, 311, 322; 422/171, 180; 55/466, 523, DIG. 30

[56] References Cited

U.S. PATENT DOCUMENTS 3,978,567 9/1976 Vroman ..... 422/171
4,278,639 7/1981 Tadokoro ..... 422/171
4,425,304 1/1984 Kawata ..... 422/171

FOREIGN PATENT DOCUMENTS 215914 12/1984 Japan ..... 422/171

*Primary Examiner*—Douglas Hart
*Attorney, Agent, or Firm*—McGlew & Tuttle

[57] ABSTRACT

Device for the catalytic cleaning of or soot removal from exhaust gases of internal combustion engines, comprising a housing that has two open end zones connected to an exhaust gas line and a flow passage for the exhaust gases between the end zones. Two flow-carrying exhaust gas treating bodies are held in housing one behind another in the direction of flow and at spaced locations from one another. A protective ring, is provided surrounding the space between the two exhaust gas treating bodies on the outside. The protective ring is held in the housing in a form-fit manner in the axial direction by a holding member surrounding it on the outside. An axial clearance is provided between the protective ring and at least of the two exhaust gas treating bodies in the installed state.

19 Claims, 7 Drawing Sheets

DEVICE FOR THE CATALYTIC CLEANING OR OTHER TREATMENT OF INTERNAL COMBUSTION ENGINE EXHAUST GASES WITH TWO EXHAUST GAS TREATING BODIES AND A PROTECTIVE RING BETWEEN THEM

FIELD AND BACKGROUND OF THE INVENTION

The present invention pertains to a device for the catalytic cleaning of or soot removal from internal combustion engine exhaust gases, comprising a housing that has two open end zones connected to an exhaust gas line and a flow passage for the exhaust gas between the end zones. Two flow-carrying exhaust gas treating bodies are held in the housing at spaced locations from each other, and a rigid protective ring is provided surrounding the space between the two exhaust gas treating bodies on the outside.

In a prior-art device of this type for the catalytic cleaning of exhaust gas, the protective ring consists of a high temperature-resistant sheet metal which surrounds the two connected exhaust gas treating bodies—ceramic monoliths with catalytically active coating in the prior-art device—at least in the end zones adjoining the protective ring. The connections between the protective ring and the two monoliths are problematic, because high local stresses occur there, and difficult-to-control relative movements occur between the protective ring and the exhaust gas treating bodies during operation because of the thermal expansion at the high exhaust gas temperatures.

A device for catalytic cleaning of exhaust gases, in which the exhaust gas treating bodies are ceramic: monoliths with catalytically active coating, is known from West German Auslegeschrift No. DE-A 36,26,728. Among other things, a rigid protective ring is described there, whose end faces are in contact with the two adjoining exhaust gas treating bodies and whose cylindrical outer circumferential surface is aligned with the outer circumferential surfaces of the two adjoining exhaust gas treating bodies.

SUMMARY AND OBJECT OF THE INVENTION

Compared with a protective ring made of sheet metal, a ceramic protective ring has the advantage of having substantially lower thermal expansion and thermal conductivity.

It is an object of the present invention to provide a solution for a protective ring which is more favorable in terms of the behavior at varying temperatures and in terms of manufacture.

To accomplish this task, the device according to the present invention is characterized in that the protective ring is held in the housing in a form-fit manner by means of a holding member surrounding it on the outside. An axial clearance is provided between the protective ring and at least one of the two exhaust gas treating bodies in the installed state.

An axial clearance is preferably provided on both sides of the protective ring.

According to the present invention, the protective ring is essentially disconnected from the two exhaust gas treating bodies and is held independently and in a form-fit manner in the housing. Edge pressures between the protective ring and the treating bodies and the need to maintain close process tolerances are avoided. Because the axial clearance or the two axial tolerances preferably is/are close, the effect of the exposure to the hot exhaust gases through the axial clearance farther downward in the housing remains within acceptable limits. The present invention provides a more favorable solution to the protective ring with respect to the behavior at varying temperatures and the production technology.

The preferred specific means for the form-fit fixation of the protective ring are at least one circular bead or at least one circular recess on the outside of the protective ring. The housing proper, with which the holding member is in contact on the outside, can be designed, e.g., with at least a circular bead projecting outward or inward so that the holding member and hence the protective ring are fixed reliably in the axial direction. The device is particularly favorable in terms of design if the holding member is part of a holding mat holding the two exhaust gas treating bodies. Specifically, the design can also be such that the holding member of the protective ring designed as a holding mat also surrounds axially the two adjoining exhaust gas treating bodies over only a certain distance and another holding mat is provided axially next to it for each exhaust gas treating body. The holding mat preferably consists of ceramic fibers or is designed as a so- called swelling mat, whose volume increases as the temperature rises. Swelling mats are commercially available. However, the holding mat may also consist of wire mesh. Even if the holding member is not part of a longer mat, the holding member may consist of the same material, as is known in the case of swelling mats.

The protective ring is preferably a rigid ceramic protective ring. Based on the axial clearance, this material can be used without problems, without the risk of edge pressure, and it provides a certain heat insulating effect. This has the advantage that the swelling mat material of the holding member does indeed become hot enough for swelling through the protective ring. However, the protective ring may also be made of high temperature-resistant sheet metal.

Especially in the case of holding the protective ring by a swelling mat material, the ceramic material of the protective ring is selected so as to achieve a relatively good thermal conductivity. This offers the advantage that the swelling mat material of the holding member does indeed become hot enough for swelling through the protective ring.

The protective ring is preferably surrounded by an intermediate layer over at least part of its axial length. This intermediate layer can act as a mounting aid in order to make it easier for the protective ring and, if desired, also the exhaust gas treating bodies to slip into the correct installed position during the assembly of the device. The intermediate layer can also serve as an additional protection in the contact zone between the protective ring and the adjoining exhaust gas treating body or in the zone of the axial clearance existing there, against the effect of the hot exhaust gases.

The holding member is preferably mounted in the radially pre-tensioned state, so that the protective ring is held securely even when the radial dimension of the annular space between the protective ring and the housing increases at high temperatures. It is preferably a nonrigid, elastic holder, which still has a fixing and tightening effect.

More than two exhaust gas treating bodies may also be present in the housing of the device, arranged one behind the other in the direction of flow, and protective rings according to the present invention are preferably provided for all spaces between any two adjacent exhaust gas treating bodies.

Typical examples of exhaust gas treating bodies provided are ceramic monoliths with longitudinal channels and catalytically active coating for exhaust gas cleaning and screen-like soot particle filters which may consist of ceramic material, but also metallic material.

AlTiO, $SiO_2$, $ZrO_2$, and cordierite may be considered suitable ceramic materials for the protective ring. Silicon carbides and silicon nitrides may be considered as ceramic materials that can be advantageously used in the case of the desired high thermal conductivity such as can be reached with ceramic materials. Ceramic fabrics are particularly suitable for the intermediate layer.

Ceramic protective rings with practically any desired section profile can be produced especially according to the process known as slip casting. However, it is preferable within the framework of the present invention to impart to the protective ring such a shape that it can be produced according to the substantially less expensive pressing process. A particularly important prerequisite for the ability of the protective ring to be produced according to the pressing process is, as is preferable according to the present invention, to design its inner circumference such that the inner mold part or the inner mold parts of the press mold used for the production can be pulled out in the axial direction. In other words, the inner circumference of the protective ring shall have no undercuts, which would make it impossible to pull out the inner mold parts, at least beginning from the plane of division between two inner mold parts. In contrast, the shaping of the outer circumference of the protective ring is not specifically critical, because it is possible there, for example, to move the outer mold parts away in the radial direction.

Furthermore, in a further developed variant of the present invention, the protective ring has at least two zones at least on the end face, distributed on the circumference, in which the protective ring end face has a greater height, measured radially, than it has next to the zone in question. These end face zones with greater radial extension can serve as more effective contact surfaces for small spacer plates. These are placed between the protective ring and the adjacent exhaust gas treating body during the assembly of the device in order to align the protective ring between the two exhaust gas treating bodies without canting. The spacer plates preferably consist of a material, especially a plastic, which burns off at a higher temperature during the first operation of the exhaust gas treating device. It is favorable to provide such end face zones with greater radial height on both end faces of the protective ring and to distribute more than two such zones over the actual circumference.

According to an embodiment of the present invention, it is possible to provide the protective ring with a section profile that changes in the circumferential direction of the protective ring. This variant is particularly favorable when the protective ring is not circular, but especially oval, rounded-triangular, etc. In this case, the protective ring may have, for example, a profile leading to greater strength against the bending moments occurring in the circumferential zones in which the protective ring has a relatively smaller radius of curvature.

Especially in the case of circular protective rings, it may be advantageous for the protective ring to have a projecting lug at least at one point of its outer circumference for fixing the protective ring more securely in the housing in the circumferential direction. The lugs can most advantageously be located in a plane of division of the housing.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE PREFERRED EMBODIMENTS

Figure 1:
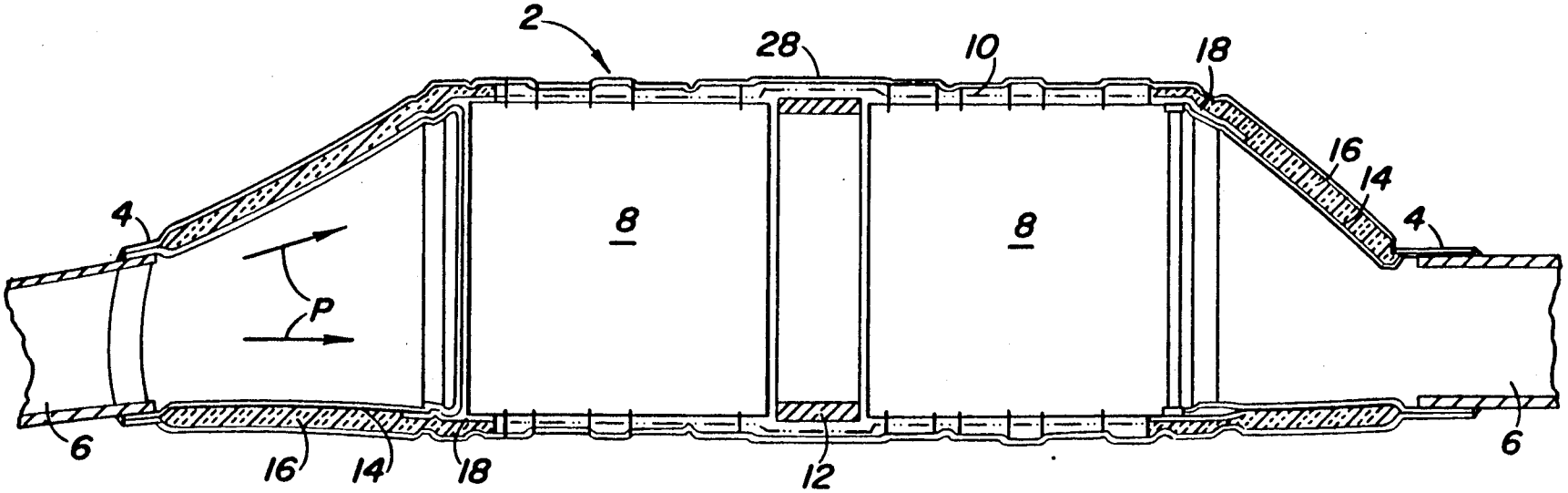
FIG. 1 is a longitudinal sectional view of an exhaust gas cleaning device according to the invention.

The device shown in FIG. 1 shows an essentially cylindrical housing 2 which tapers toward the end zones 4 o both sides. Each of said end zones 4 is welded onto the open end of an exhaust gas line 6. Two ceramic monoliths 8 with catalytically active coating for cleaning the exhaust gases of an internal combustion engine are held in said housing 2 one behind the other in the direction of flow at spaced locations from one another by a swelling mat 10 placed around them. A ceramic protective ring 12 is arranged axially between the two monoliths 8 serving as exhaust gas treating bodies. An inner shell 14 each of high temperature-resistant sheet metal, which ends at a closely spaced location in front of each monolith 8, is arranged in the tapered zones of the housing 2. An insulating mat 16 consisting, e.g., of ceramic fibers, is located between the inner shells 14 and said housing 2. There is a flow passage in the direction of the arrows P through the device from the end of the left exhaust gas line 6 through the left inner shell 14, through longitudinal channels of the left monolith 8, through the protective ring 12, through the longitudinal channels of the right monolith 8, and through said right inner shell 14 to the end of said right exhaust gas line 6.

The protective ring 12 has a rectangular cross section. There is an axial clearance 24 between its two flat front edges and the outer zones of the front sides of the two adjoining monoliths 8. The outer diameter of the protective ring 12 is somewhat greater than the outer diameter of the two monoliths 8, so that the protective ring 12 is embedded in the swelling mat 10 in a form-fit manner. In the zone in which the protective ring 12 is arranged, the housing 2 has a circular bead 28 projecting in the outward direction.

An intermediate layer 18 consisting of ceramic fabric represented by dotted lines is seen at the transition of the mat between the inner shell 14 and the corresponding monolith 8.

Figure 2:
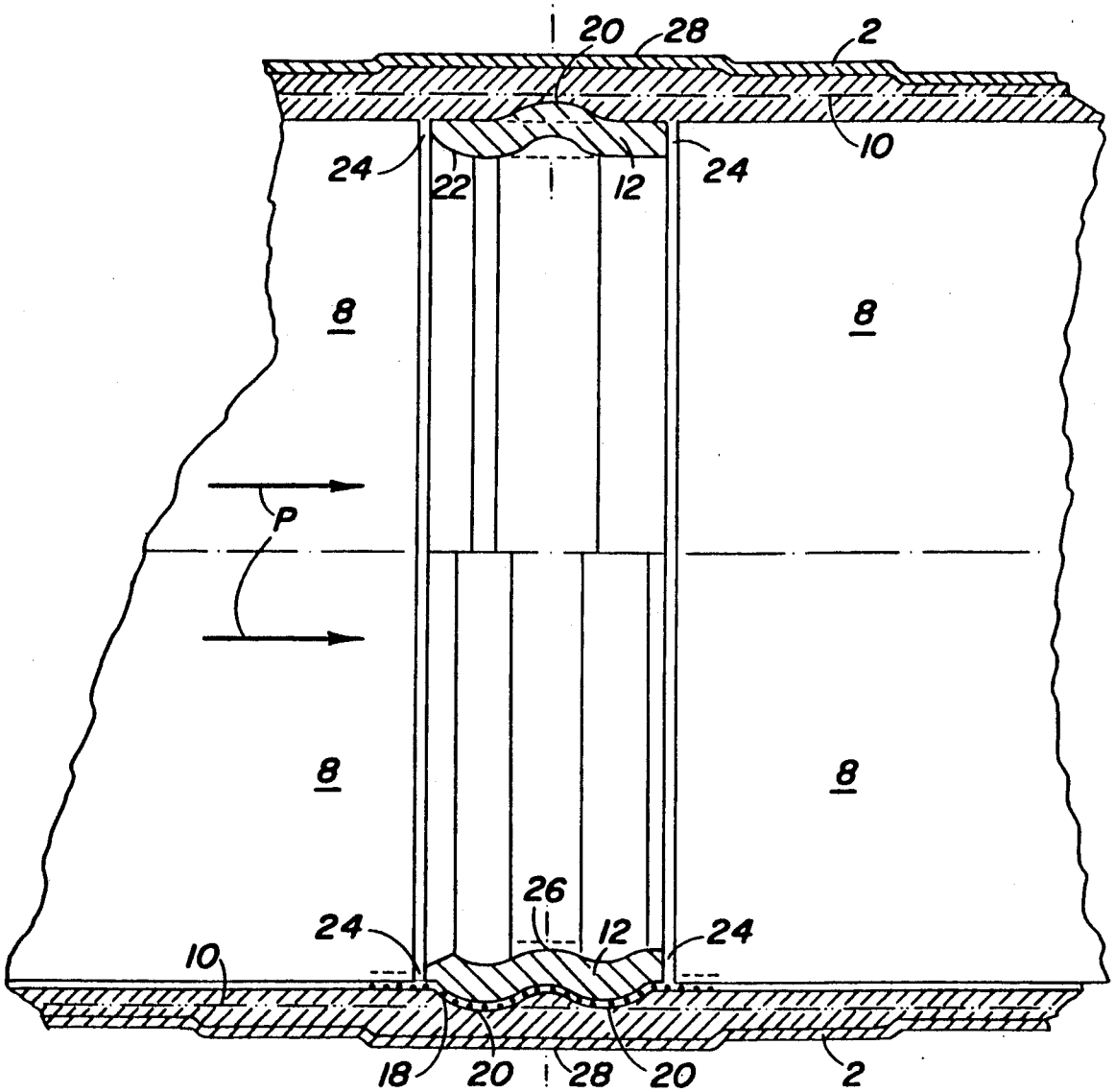
FIG. 2 is a cross-sectional view showing a further protective ring configurations on a larger scale, specifically, four different variants top left, top right, bottom left, and bottom right.

In the embodiment according to the top part of FIG. 2, the protective ring 12 has a cross section profile forming a circular outer bead 20. This causes the swelling mat 10 to be compressed more strongly radially in this zone.

In the embodiment according to the lower part of FIG. 2, the said protective ring 12 has a corrugated section profile, as a result of which particularly good, form-fit anchoring with the swelling mat 10 is achieved. In addition, an intermediate layer 18 consisting of ceramic fabric, represented by a series of dots, is shown at the inflow side axial clearance 24. The intermediate layer 18 is located between the swelling mat 10 and the circumferential end zone of the monolith 8 as well as the circumferential end zone of the protective ring 12, which is on the left in FIG. 2. It would also be possible to provide a corresponding intermediate layer 18 at the right axial clearance 24 or at both axial clearances 24.

The variant in which the internal cross section of the protective ring 12 conically expands toward the axial end is shown in the left-hand part of the drawing in both the embodiment according to the top part of FIG. 2 and in the embodiment according to the lower part of FIG. 2. This can be provided at one or both axial ends. This leads to minimized coverage or even complete elimination of the coverage of the front edge of said monolith 8 by the protective ring 12.

Figure 3:
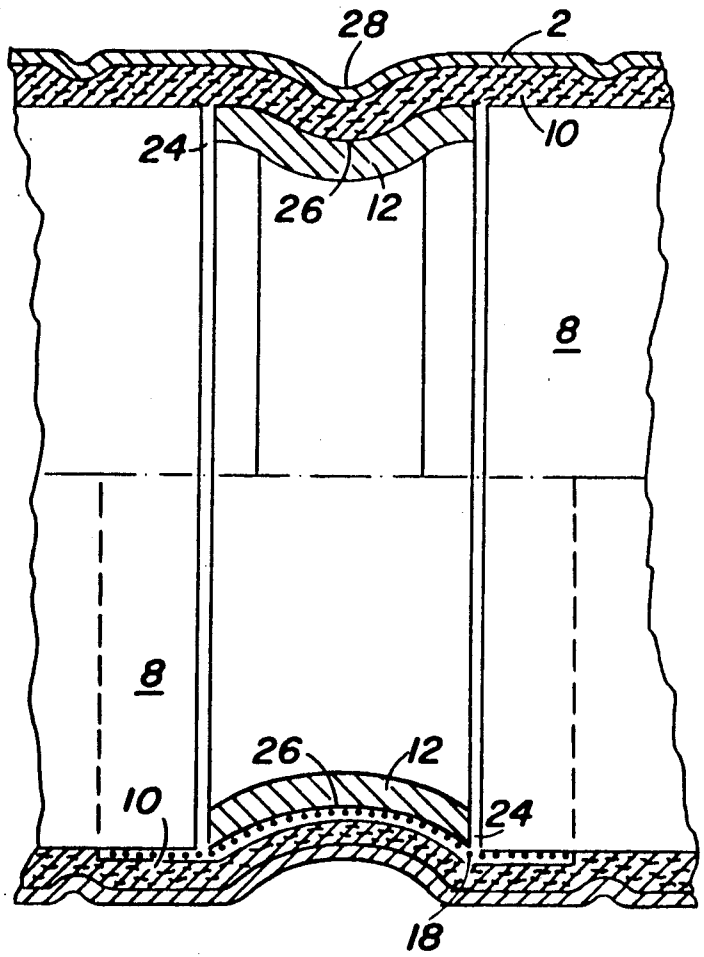
FIG. 3 is a cross-sectional view showing a further protective ring configurations in a representation similar to FIG. 2, specifically, different variants at the top and bottom of the drawing.

In the embodiment according to the top part of FIG. 3, the protective ring 12 has a sectiòn profile which forms a central, external circular recess 26. In the corresponding area, the housing 2 has a circular bead 28 projecting in the inward direction, so that the swelling mat 10 has a double S- shaped change in direction.

In the embodiment according to the lower part of FIG. 3, the section profile of said protective ring 12 is as a whole convex toward the inside. The housing 2 has a corresponding circular bead 28 projecting in the inward direction. In addition, an intermediate layer 18 consisting of ceramic fibers is seen, which covers the two axial clearances and one of the end zones of the outer circumference of the two adjoining monoliths 8.

It is pointed out that the inner shells 14 shown in FIG. 1 may alternatively also extend in the axial direction, i.e., they can surround at least an end zone of the monoliths 8, or they may pass over the entire housing 2 as a united part. In this case, the inner shell should be considered to be a housing holding the protective ring 12. It may also be pointed out that the swelling mat 10 can penetrate as a bead into the axial clearance 24 to a certain extent, as a result of which a padding is formed between the monolith 8 and the protective ring 12. Finally, one should also mention the possibility of providing the protective ring 12 between two monoliths 8 of different cross section size, e.g., as a whole essentially as a conical protective ring between two coaxial monoliths 8 with different cross section size or asymmetrically between a first monolith 8 with a larger cross section and a second monolith 8 with a smaller cross section, whose central axis is displaced.

The material selected for the intermediate layer 18 can be smoother than that of said swelling mat 10. In this case, said protective ring will slip into its correct mounting position in the axial direction more easily on assembly of the device, especially if said housing 2 is made of two half shells that are finally welded together, and this is additionally facilitated by the form-fit mounting of the protective ring. In view of this function, the material of the intermediate layer 18 can be selected as a material that burns during the operation of the device. If a temperature resistant material is selected, a protective effect is obtained for the holding mat 10.

Figure 4:
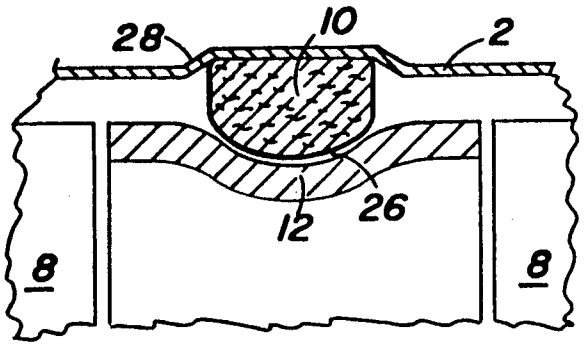

In the embodiment according to FIG. 4, said protective ring 12 has a section profile similar to that in the embodiment according to the top part of FIG. 3, but a holding ring 10 made of wire mesh, which is located in said recess 26 of said protective ring 12 on the inside and in an outwardly projecting bead 28 of said housing 2 on the outside, is provided as the holding member. A holding member 10 made of wire mesh is particularly favorable if the heat conducted to the outside through said protective ring 12 is not sufficient to heat the swelling mat, located adjacent thereto, sufficiently for swelling. However, it is also possible to provide a holding mat, especially one made of ceramic fiber material or swelling mat material, positioned between the external circumference of said wire mesh ring 10 and said housing 2.

Figure 5:
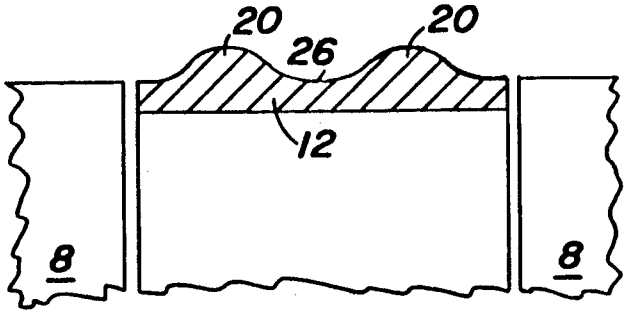

In the embodiment according to FIG. 5, said protective ring 12 has an external circumferential shape similar to said protective ring 12 in the bottom part of FIG. 2. However, the internal circumference of s id protective ring 12 is straight and parallel to the longitudinal axis of the device in the section shown. As a consequence of this, said protective ring 12 has a radial material thickness which changes in the axial direction of said protective ring 12.

Figure 6:
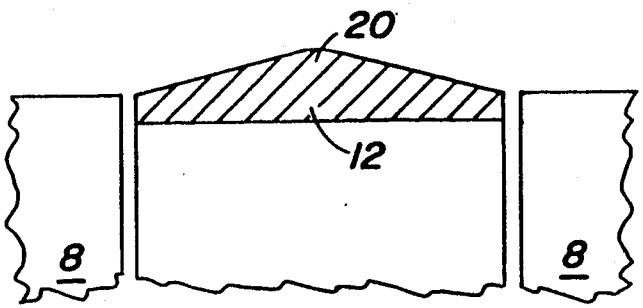
FIGS. 4 through 8 are cross-sectional views showing further protective ring configurations as details of longitudinal sections.

In the embodiment according to FIG. 6, said protective ring 12 has a longitudinal section profile which corresponds to a rectangle with a rounded triangle placed over it. The internal circumference of said protective ring 12 is designed as in the case of the embodiment according to FIG. 5.

Figure 7:
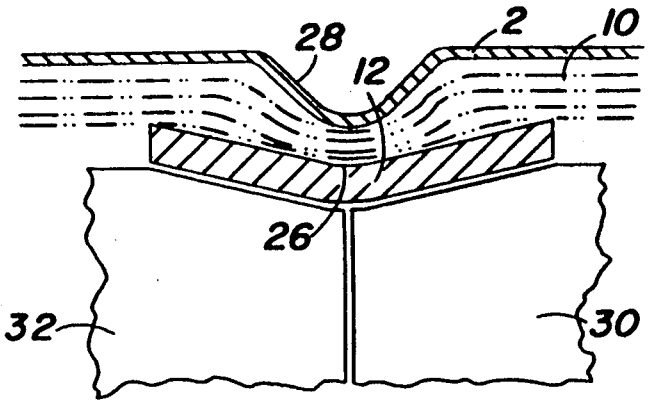

In the embodiment according to FIG. 7, said protective ring 12 has a longitudinal section profile which differs from the rectangular profile according to FIG. 1 in that both the axial circumference and the internal circumference are reduced in the axial middle zone. A recess 26 is thus formed in the axial middle zone of the external circumference. In this zone, said housing has an inwardly projecting bead 28, whose slope angle is steeper than the slope angle on the external circumference of said protective ring 12.

The common feature of the embodiments according to FIGS. 4 through 7 is that said protective ring 12 can be produced according to the inexpensive pressing process. In the embodiments according to FIGS. 5 and 6, the internal circumference of the protective ring has no undercut at all, so that the inner mold part of the press mold used for the production can be removed without problems in the axial direction. In the embodiments according to FIGS. 4 and 7, it is possible to operate with two inner mold parts, which are identified by the reference numerals 30 and 32 in FIG. 7. The plane of division between the two inner mold parts 30 and 32 is located in the area of the smallest internal diameter of said protective ring 12. It is seen that said inner mold parts 30 and 32 can be pulled out axially without problems when said protective ring 12 is produced according to the pressing process.

Figure 8:
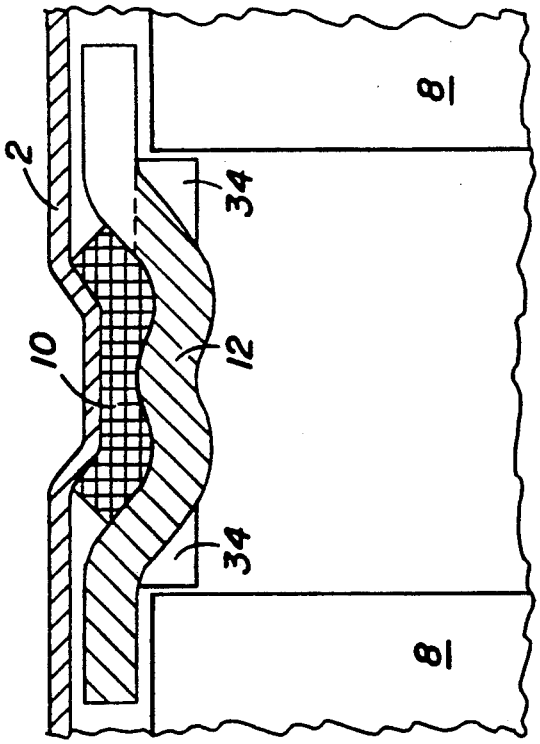

The embodiment according to FIG. 8 shows the peculiarity that said protective ring 12 is axially longer than the free space between the two adjoining exhaust gas treating bodies 8. In its two axial end zones, said protective ring 12 has such a large internal diameter that it surrounds the two adjoining exhaust gas treating bodies 8 over a certain length. Circumferential component areas 34, which are radially farther inside than the surrounding areas described and which are located opposite the front side edge zone of the exhaust gas treating bodies 8 joining there, are provided on both sides of said protective ring 12. The front sides of said areas 34 can serve as contact surfaces for the spacer plates described in the introduction of the description.

Figure 10:
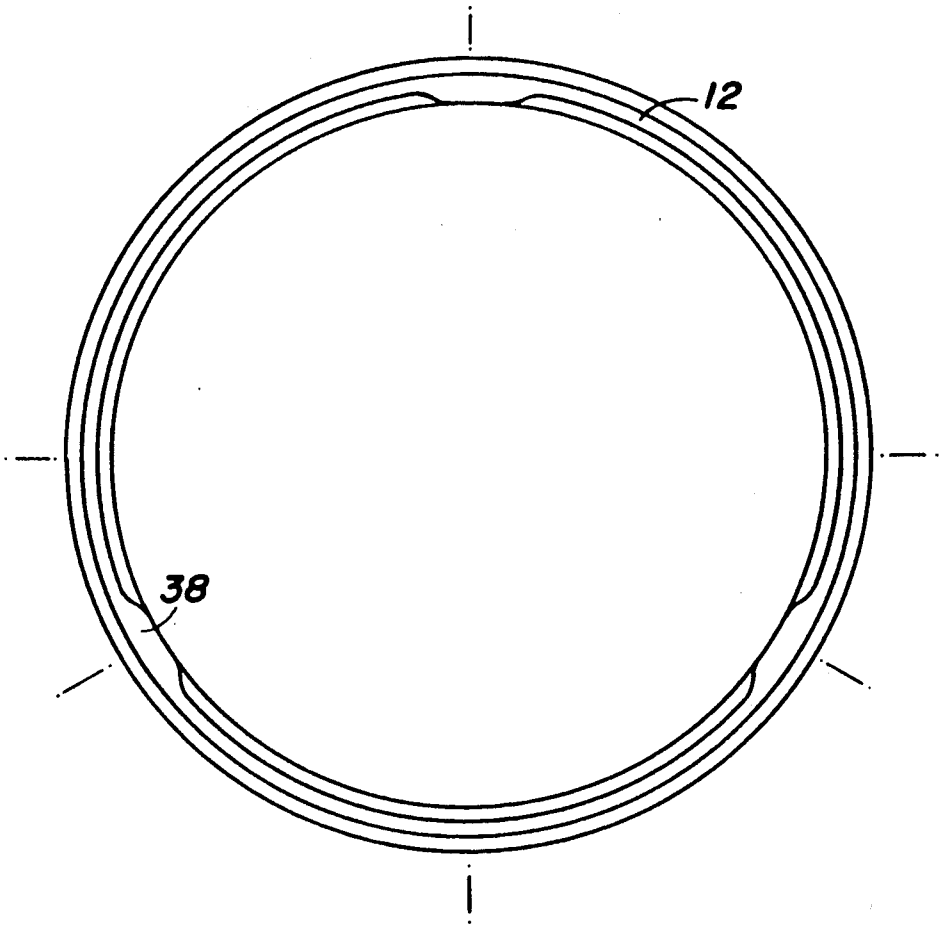
FIG. 10 is a top view of a further protective ring configuration.
Figure 9:
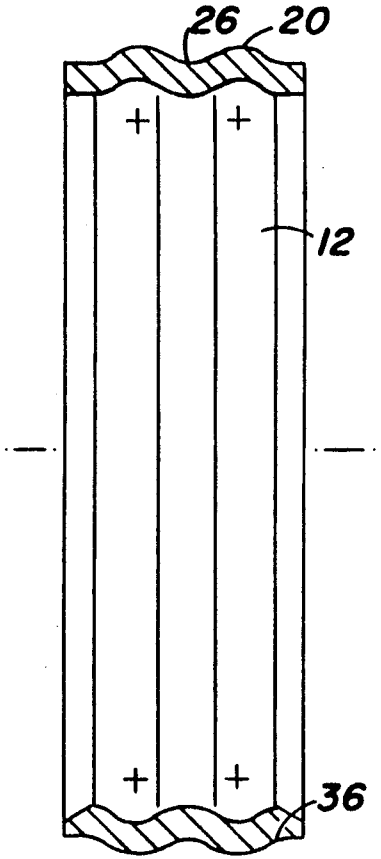
FIG. 9 is a longitudinal sectional view of a further protective ring configuration.

In the embodiment according to FIGS. 9 and 10, said protective ring has a longitudinal section profile similar to the protective ring 12 according to the bottom part of FIG. 2. However, in its two end zones, said protective ring 12 is provided on the inside with bevels 36 expanding conically to the outside, which are distributed on the circumference at a angles smaller than ca. 120°. Thus, three zones 38, which have the full height of said protective ring on the respective protective ring front side, are thus left between said beveled zones 36. Said zones 38 can serve as contact surfaces for the spacer plates described in the introduction of the description. Said bevels 36 can be prepared, for example, by grinding off. As a consequence of said bevels 36, only a very small edge zone of the end faces of the two adjacent monoliths 8 is covered.

Figure 13:
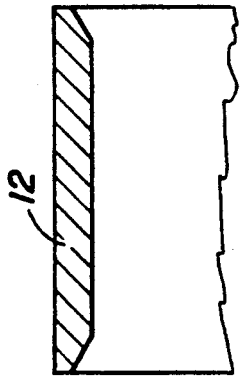
FIGS. 12 and 13 are longitudinal sectional views of the protective ring according to FIG. 11 taken along line 12—12 and line 13—13, respectively, in FIG. 11.
Figure 12:
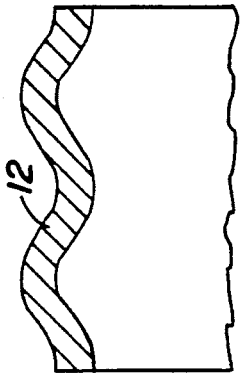
Figure 11:
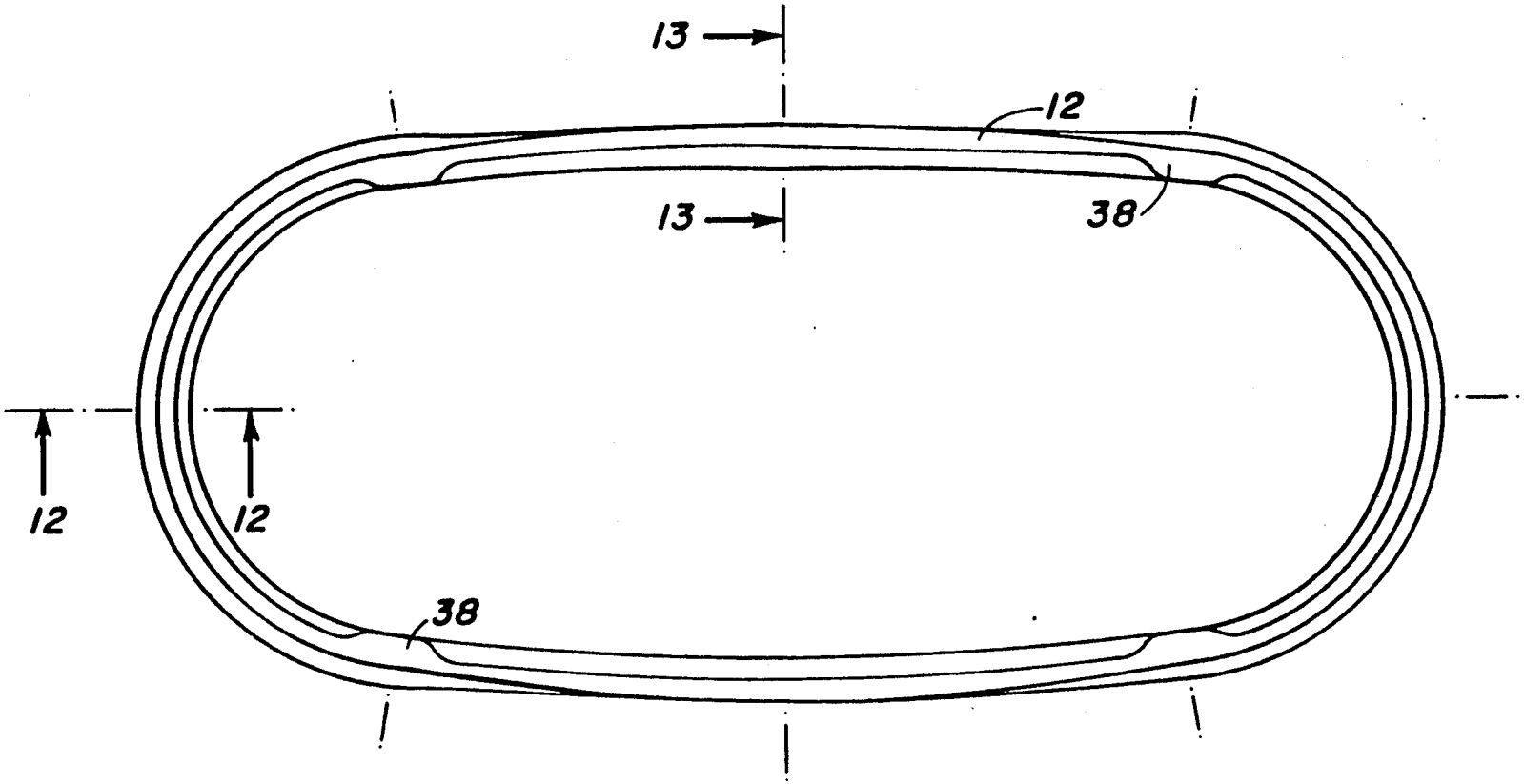
FIG. 11 is a front view of another protective ring configuration.

In the embodiment according to FIGS. 11 through 13, there is an essentially oval protective ring 12, which has the particular feature that said protective ring 12 has a corrugated profile according to FIG. 12 in the zone of its relatively smaller radius of curvature and an essentially rectangular profile according to FIG. 13 in the zone of its relatively larger radius of curvature. Said protective ring 12 thus has greater resistance to bending loads in the zones with the relatively smaller radius of curvature and is more elastic to bending loads in the zones of its relatively larger radius of curvature. Areas 38 as shown in the embodiment according to FIGS. 9 and 10 are also recognizable.

Figure 14:
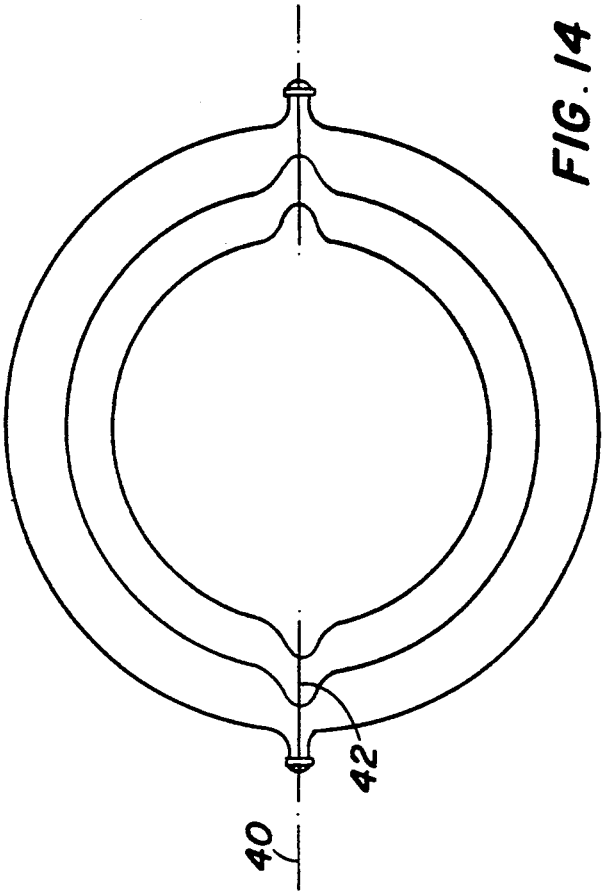
FIG. 14 is a front view of still another protective ring configuration.

According to the embodiment of FIG. 14, said protective ring 12 can have lugs 42 projecting outward in the plane of division 40 of aid housing 2, as a result of which it is fixed in a form-fit manner in the circumferential direction.

It is emphasized that said protective ring 12 according to the present invention may either be circular or have another shape, especially oval, elliptical, rounded-triangular, rounded-rectangular, etc., in its front view.

It is also emphasized that the variants described above in terms of the longitudinal section profile of said protective ring 12, the shape and material of said holding member 10, the variation of the section profile of the circumference of said protective ring, the presence of spacer plate contact surfaces 38, etc., may be combined in any way desired. For example, the wire mesh holding ring 10 shown in FIG. 4 may be used in all protective ring configurations. Furthermore, for example, said spacer plate contact zones 38 may be provided in all protective ring configurations. Finally, for example, the variation of the section profile along the circumference of said protective ring, which is illustrated in FIGS. 11 through 13, can also be realized with other specific protective ring section profiles.

Finally, it is emphasized that said protective ring 12 does not have to be symmetrical to a midplane intersecting its axis at right angles. It may be designed somewhat differently on the left side and the right side, and, in particular, it may have legs of different lengths on the left side and the right side.

While specific embodiments of the invention have been shown and described in detail to illustrate the application of the principles of the invention, it will be understood that the invention may be embodied otherwise without departing from such principles.

What is claimed is:

1. A device for treating exhaust gases of internal combustion engines, comprising: a housing with first and second end zones, said end zones being spaced apart a predetermined distance, each end zone being connected to an exhaust line to define an exhaust gas flow passage between the end zones; first and second exhaust gas treating bodies positioned between said end zones within said housing one behind the other in the direction of flow for exhaust gas flow therethrough, said first exhaust gas treating body being limited in movement in one direction by said first end zone and said second exhaust gas treating body being limited in movement in another direction by said second end zone; a molded ceramic protective ring positioned between said exhaust gas treating bodies, and, holding means positioned between said housing and said protective ring, surrounding said protective ring on an outer side of said protective ring to hold said protective ring in said housing in a form-fit manner, said first and second exhaust gas treating bodies and said protective ring combining to have a total axial length smaller than said predetermined distance, said holding means holding said protective ring to define an axial clearance between said protective ring and at least one of the first and second exhaust gas treating bodies.

2. A device according to claim 1, wherein said protective ring includes at least one of a circular bulge and a circular recess on said outer side.

3. A device according to claim 1, wherein said holding means is fixed in said housing in a form-fit manner to restrict movement of said holding means in an axial direction.

4. A device according to claim 3, wherein said housing includes at least one circular bead adjacent a zone in which the protective ring is positioned.

5. A device according to Claim 1, wherein said holding means comprises a holding mat for holding said first and second exhaust gas treating bodies.

6. A device according to Claim 1, wherein said holding means is formed of a swelling mat material.

7. A device according to Claim 1, wherein said protective ring is formed of a rigid ceramic material.

8. A device according to Claim 7, wherein said rigid ceramic material forming said protective ring provides good thermal conductivity.

9. A device according to Claim 1, wherein said protective ring is surrounded by an intermediate layer over at least part of said protective ring's axial length.

10. A device according to claim 1, wherein said protective 15 ring has an inner circumference shaped by inner mold parts, such that each of the inner mold parts may be pulled out in an axial direction with respect to the protective ring.

11. A device according to claim 1, wherein said protective ring includes at least two zones on an end face, distributed over the circumference of the end face, said protective ring having a greater radial height at said end face except for said at least two zones.

12. A device according to claim 1, wherein said protective ring has a section profile which changes in a circumferential direction of said protective ring.

13. A device according to claim 1, wherein said protective ring has a projection lug provided at least one point of an outer circumference of said protective ring, said projecting lug holding said protective ring securely in a circumferential direction.

14. A device for exhaust gas treatment of internal combustion engines, comprising: a housing with first and second end zones, each end zone being connected to an exhaust line to define an exhaust gas flow passage between the end zones; first and second exhaust gas treating bodies positioned within said housing one behind the other in the direction of flow for exhaust gas flow therethrough, said first exhaust gas treating body being limited in movement in a first direction by said first end zone, said second exhaust body being limited in movement in a second direction by said second end zone, said first end zones being spaced apart a predetermined distance, said predetermined distance being larger than a length of said first exhaust gas body and said second exhaust gas body said first and second exhaust gas treating bodies being positioned at spaced locations from one another to define an intermediate space; a molded ceramic protective ring positioned between said exhaust gas treating bodies in the intermediate space, said protective ring having an axial length smaller than a length of said intermediate space to define an axial clearance being defined between said protective ring and at least one of the first and second exhaust gas treating bodies said protective ring having a central circular recess projecting inwardly from said housing, said housing having a corresponding projecting extending in an inward direction; and, holding means positioned between said housing and said protective ring, surrounding said protective ring on an outer side of said protective ring to hold said protective ring in said housing in a form-fit manner.

15. A device for exhaust gas treatment of internal combustion engines comprising;

a housing having a first end zone and a second end zone, each of said first end zone and said second end zone being connected to an exhaust line to define an exhaust gas flow passage between the end zones, said first end zone and said second end zone being spaced a predetermined distance to define a predetermined exhaust gas flow passage axial length;

a first exhaust gas treating body having a first end face and a second end face, said first exhaust gas treating body being positioned within said exhaust gas flow passage with said first end face adjacent said first end zone;

a second exhaust gas treating body having a first end face and a second end face, said second exhaust gas treating body being positioned within said exhaust gas flow passage with said second end face of said second exhaust gas treating body positioned adjacent said first end zone, said first exhaust gas treating body being limited in movement in an upstream direction by said first end zone, and said second exhaust gas treating body being limited in movement in a downstream direction by said second end zone, said first exhaust gas treating body having a maximum axial length, and said second exhaust gas treating body having a maximum axial length, said first exhaust gas treating body maximum axial length, and said second exhaust gas treating body maximum axial length being smaller than said exhaust gas flow passage axial length by an amount equal to an intermediate space provided between said first exhaust gas treating body and said second exhaust gas treating body;

a protective ring positioned in said temperature space, said protective ring having a maximum axial length which is smaller than a minimum axial length of said intermediate space; and holding means positioned between said housing and said protective ring, surrounding said protective ring on an outer side of said protective ring to hold said protective ring in said housing in a form-fit manner and position said protective ring in said intermediate space to define an axial clearance between said protective ring and said first exhaust gas treating body and to define an axial space between said protective ring and second exhaust gas treating body.

16. A device according to claim 15, wherein said protective ring includes an angled end face opposite said first exhaust gas treating body second end face and angled end face opposite said second exhaust gas treating body first end face.

17. A device according to claim 16, wherein said protective ring is a molded ceramic element and each of said first and second exhaust gas treating bodies are ceramic monoliths.

18. A device according to claim 17, wherein said holding means comprises a swelling mat including swelling means having a volume which increases as temperature rises to maintain the position of said protective ring upon thermal expansion of said housing.

19. A device according to clam 15, wherein said holding means comprises a swelling mat including means for increasing the volume of said dwelling mat as the temperature rises in said exhaust gas flow passage, said protective ring being formed with a material with good thermal conductivity allowing said swelling mat to become hot enough for swelling via heat from said protective ring.

* * * * *